US011574510B2

(12) United States Patent
Chen et al.

(10) Patent No.: US 11,574,510 B2
(45) Date of Patent: Feb. 7, 2023

(54) MULTI-FUNCTIONAL AUTOMOTIVE DIAGNOSTIC TABLET WITH INTERCHANGEABLE FUNCTION-SPECIFIC CARTRIDGES

(71) Applicant: Innova Electronics Corporation, Irvine, CA (US)

(72) Inventors: Ieon Chen, Irvine, CA (US); John Protti, Irvine, CA (US); Doug Constable, Irvine, CA (US)

(73) Assignee: Innova Electronics Corporation, Irvine, CA (US)

( * ) Notice: Subject to any disclaimer, the term of this patent is extended or adjusted under 35 U.S.C. 154(b) by 309 days.

(21) Appl. No.: 16/833,963

(22) Filed: Mar. 30, 2020

(65) Prior Publication Data

US 2021/0304530 A1 Sep. 30, 2021

(51) Int. Cl.
*G07C 5/08* (2006.01)

(52) U.S. Cl.
CPC ..... *G07C 5/0883* (2013.01); *G07C 5/0808* (2013.01); *G07C 2205/02* (2013.01)

(58) Field of Classification Search
CPC ..... G07C 5/0883; G07C 5/0808; G07C 2205/02; G07C 5/0825
See application file for complete search history.

(56) References Cited

U.S. PATENT DOCUMENTS

| | | | |
|---|---|---|---|
| 2,292,387 | A | 8/1942 | Hedy et al. |
| 2,960,654 | A | 11/1960 | Nelson |
| 3,646,438 | A | 2/1972 | Staff |
| 4,041,380 | A | 8/1977 | Epstein |

(Continued)

FOREIGN PATENT DOCUMENTS

| | | | |
|---|---|---|---|
| DE | 3832123 | C2 | 3/1990 |
| DE | 10139931 | B4 | 2/2013 |

(Continued)

OTHER PUBLICATIONS

OTC's Latest Innovations, 1989 ( 6 pages), (month not available).

(Continued)

*Primary Examiner* — Michael V Kerrigan
(74) *Attorney, Agent, or Firm* — Stetina Brunda Garred & Brucker

(57) ABSTRACT

A multi-functional automotive diagnostic device includes a base unit having a display screen and a base electrical connector. The device additionally includes a first cartridge including a first body, a first electrical connector, and a first automotive tool. The device further includes a second cartridge including a second body, a second electrical connector, and a second automotive tool. The first and second cartridges are interchangeably engageable with the base unit, such that engagement of the first cartridge to the base unit occurs when the first electrical connector is electrically connected to the base electrical connector which configures the base unit to operate in accordance with the first automotive tool and engagement of the second cartridge to the base unit occurs when the second electrical connector is electrically connected to the base electrical connector which configures the base unit to operate in accordance with the second automotive tool.

17 Claims, 4 Drawing Sheets

(56) References Cited

U.S. PATENT DOCUMENTS 4,112,748 A 9/1978 Walley
4,176,315 A 11/1979 Sunnarborg
4,207,611 A 6/1980 Gordon
4,404,639 A 9/1983 McGuire et al.
4,602,127 A 7/1986 Neely et al.
4,684,896 A 8/1987 Weishaupt
4,689,573 A 8/1987 Hilmer
4,831,560 A 5/1989 Zaleski
4,859,932 A 8/1989 Whitley
4,884,033 A 11/1989 McConchie, Sr.
5,003,478 A 3/1991 Kobayashi et al.
5,005,129 A 4/1991 Abe et al.
5,032,791 A 7/1991 Bates
5,107,428 A 4/1992 Bethencourt et al.
5,157,610 A 10/1992 Asano et al.
5,157,708 A 10/1992 Garthwaite et al.
5,170,125 A 12/1992 Bates
D334,560 S 4/1993 Wilson
5,214,582 A 5/1993 Gray
5,247,245 A 9/1993 Nelson
5,278,508 A 1/1994 Bowman
5,285,163 A 2/1994 Liotta
5,345,384 A 9/1994 Przybyla et al.
5,347,211 A 9/1994 Jakubowski
5,359,290 A 10/1994 Cervas
5,394,093 A 2/1995 Cervas
5,400,018 A 3/1995 Scholl et al.
5,442,553 A 8/1995 Parrillo
5,481,906 A 1/1996 Nagayoshi et al.
5,491,418 A 2/1996 Alfaro et al.
5,491,631 A 2/1996 Shirane et al.
5,499,182 A 3/1996 Ousborne
5,506,772 A 4/1996 Kubozono et al.
5,519,397 A 5/1996 Chapotot et al.
5,532,927 A 7/1996 Pink et al.
5,535,274 A 7/1996 Braitberg et al.
5,541,840 A 7/1996 Gurne et al.
D377,622 S 1/1997 Chen et al.
5,619,412 A 4/1997 Hapka
5,623,922 A 4/1997 Smith
5,631,831 A 5/1997 Bird et al.
5,635,841 A 6/1997 Taylor
5,657,233 A 8/1997 Cherrington et al.
5,668,880 A 9/1997 Alajajian
5,671,141 A 9/1997 Smith et al.
5,732,074 A 3/1998 Spaur et al.
5,758,300 A 5/1998 Abe
5,767,681 A 6/1998 Huang
5,808,907 A 9/1998 Shetty et al.
5,809,437 A 9/1998 Breed
5,848,365 A 12/1998 Coverdill
5,859,628 A 1/1999 Ross et al.
5,875,413 A 2/1999 Vinci
5,884,202 A 3/1999 Arjomand
5,897,605 A 4/1999 Kohli et al.
5,915,286 A 6/1999 Figi et al.
5,916,286 A 6/1999 Seashore et al.
5,935,180 A 8/1999 Fieramosca et al.
5,961,561 A 10/1999 Wakefield, II
5,991,672 A 11/1999 Rendi et al.
6,000,413 A 12/1999 Chen
6,006,146 A 12/1999 Usui et al.
6,021,366 A 2/2000 Fieramosca et al.
6,029,000 A 2/2000 Woolsey et al.
6,031,497 A 2/2000 Nam
6,052,631 A 4/2000 Busch et al.
6,055,468 A 4/2000 Kaman et al.
6,061,638 A 5/2000 Joyce
6,094,609 A 7/2000 Arjomand
6,097,998 A 8/2000 Lancki
6,104,988 A 8/2000 Klarer
6,122,514 A 9/2000 Spaur et al.
6,141,608 A 10/2000 Rother
6,225,898 B1 5/2001 Kamiya et al.
6,263,265 B1 7/2001 Fera
6,263,268 B1 7/2001 Nathanson
6,263,322 B1 7/2001 Kirkevold et al.
6,295,492 B1 9/2001 Lang et al.
6,314,422 B1 11/2001 Barker et al.
6,330,499 B1 12/2001 Chou et al.
6,359,422 B1 3/2002 Lewis
6,359,442 B1 3/2002 Henningson et al.
6,370,454 B1 4/2002 Moore
6,389,337 B1 5/2002 Kolls
6,434,455 B1 8/2002 Snow et al.
6,438,471 B1 8/2002 Katagishi et al.
6,442,460 B1 8/2002 Larson et al.
6,459,969 B1 10/2002 Bates et al.
6,473,659 B1 10/2002 Shah et al.
6,499,385 B2 12/2002 Protti
6,529,808 B1 3/2003 Diem
6,535,112 B1 3/2003 Rothschink
6,535,802 B1 3/2003 Kramer
6,587,768 B2 7/2003 Chene et al.
6,594,579 B1 7/2003 Lowrey et al.
6,604,033 B1 8/2003 Banet et al.
6,611,740 B2 8/2003 Lowrey et al.
6,636,790 B1 10/2003 Lightner et al.
6,650,318 B1 11/2003 Amon
6,662,087 B1 12/2003 Liebl et al.
6,680,675 B1 1/2004 Suzuki
6,687,584 B2 2/2004 Andreasen et al.
6,701,233 B2 3/2004 Namaky et al.
6,718,425 B1 4/2004 Pajakowski et al.
6,732,031 B1 5/2004 Lightner et al.
6,738,696 B2 5/2004 Oi
6,771,073 B2 8/2004 Henningson et al.
6,807,469 B2 10/2004 Funkhouser et al.
6,823,243 B2 11/2004 Chinnadurai et al.
6,832,141 B2 12/2004 Skeen et al.
6,847,916 B1 1/2005 Ying
6,859,698 B2 2/2005 Schmeisser
6,868,369 B2 3/2005 Huang et al.
6,925,368 B2 8/2005 Funkhouser et al.
6,940,270 B2 9/2005 Chen
6,941,203 B2 9/2005 Chen
D510,287 S 10/2005 Chen et al.
6,957,133 B1 10/2005 Hunt et al.
6,968,733 B2 11/2005 Andreasen et al.
7,012,512 B2 3/2006 St. Denis
7,020,546 B2 3/2006 Nagai et al.
7,030,742 B2 4/2006 Treadway
7,073,714 B2 7/2006 Namaky et al.
7,085,680 B2 8/2006 Huang
7,116,216 B2 10/2006 Andreasen et al.
7,209,813 B2 4/2007 Namaky
7,225,065 B1 5/2007 Hunt et al.
D545,223 S 6/2007 Chen
D558,621 S 1/2008 Rich et al.
D559,137 S 1/2008 Protti
D560,129 S 1/2008 Rich et al.
D560,527 S 1/2008 Rich et al.
7,325,775 B2 2/2008 Chen
D563,249 S 3/2008 Chen
7,356,394 B2 4/2008 Burgess
7,363,149 B2 4/2008 Klausner et al.
D569,280 S 5/2008 Chen
7,376,497 B2 5/2008 Chen
D571,241 S 6/2008 Andreasen et al.
7,409,317 B2 8/2008 Cousin et al.
7,437,227 B2 10/2008 Andreasen et al.
D581,822 S 12/2008 Madison et al.
7,464,000 B2 12/2008 Huang
D588,621 S 3/2009 Baty
D590,387 S 4/2009 Chen
7,520,668 B2 4/2009 Chen
7,590,476 B2 9/2009 Shumate
7,603,293 B2 10/2009 Chenn
7,620,484 B1 11/2009 Chen
D610,586 S 2/2010 Chen
7,684,908 B1 3/2010 Ogilvie et al.
7,778,750 B2 8/2010 Knight et al.
7,778,752 B1 8/2010 Hunt et al.
D624,446 S 9/2010 Chen et al.

(56) References Cited

U.S. PATENT DOCUMENTS

| | | | |
|---|---|---|---|
| D624,838 | S | 10/2010 | Chen et al. |
| D625,209 | S | 10/2010 | Chen et al. |
| D625,210 | S | 10/2010 | Chen et al. |
| D625,634 | S | 10/2010 | Chen et al. |
| 7,891,004 | B1 | 2/2011 | Gelvin et al. |
| 7,904,219 | B1 | 3/2011 | Lowrey et al. |
| 8,019,503 | B2 | 9/2011 | Andreasen et al. |
| 8,024,083 | B2 | 9/2011 | Chenn |
| D646,188 | S | 10/2011 | Chen et al. |
| D646,599 | S | 10/2011 | Chen et al. |
| 8,068,951 | B2 | 11/2011 | Chen et al. |
| 8,239,094 | B2 | 8/2012 | Underdal et al. |
| 8,301,329 | B2 | 10/2012 | Andreasen et al. |
| 8,306,687 | B2 | 11/2012 | Chen |
| 8,370,018 | B2 | 2/2013 | Andreasen et al. |
| 8,509,986 | B1 | 8/2013 | Chen |
| 8,630,765 | B2 | 1/2014 | Chen |
| 8,638,207 | B2 | 1/2014 | Drew et al. |
| 8,677,019 | B2 | 3/2014 | Bruenner et al. |
| 8,825,271 | B2 | 9/2014 | Chen |
| 8,855,621 | B2 | 10/2014 | Chen |
| 8,862,117 | B2 | 10/2014 | Chen |
| 8,909,416 | B2 | 12/2014 | Chen et al. |
| 9,002,554 | B2 | 4/2015 | Chen |
| 9,014,908 | B2 | 4/2015 | Chen et al. |
| 9,019,092 | B1 | 4/2015 | Brandmaier et al. |
| 9,026,400 | B2 | 5/2015 | Chen et al. |
| 10,668,622 | B2 | 6/2020 | Pollack |
| 2001/0033225 | A1 | 10/2001 | Razavi et al. |
| 2001/0053983 | A1 | 12/2001 | Reichwein et al. |
| 2002/0007237 | A1 | 1/2002 | Phung et al. |
| 2002/0010541 | A1 | 1/2002 | Houston et al. |
| 2002/0016655 | A1 | 2/2002 | Joao |
| 2002/0035421 | A1 | 3/2002 | Warkentin |
| 2002/0128985 | A1 | 9/2002 | Greenwald |
| 2002/0156692 | A1 | 10/2002 | Squeglia et al. |
| 2002/0193925 | A1 | 12/2002 | Funkhouser et al. |
| 2003/0060953 | A1 | 3/2003 | Chen |
| 2003/0078039 | A1 | 4/2003 | Grossi et al. |
| 2003/0138475 | A1 | 7/2003 | Chen |
| 2003/0171111 | A1 | 9/2003 | Clark |
| 2003/0177417 | A1 | 9/2003 | Malhotra et al. |
| 2004/0016804 | A1 | 1/2004 | Namaky et al. |
| 2004/0044454 | A1 | 3/2004 | Ross et al. |
| 2004/0064225 | A1 | 4/2004 | Jammu et al. |
| 2004/0088087 | A1 | 5/2004 | Fukushima et al. |
| 2004/0093155 | A1 | 5/2004 | Simonds et al. |
| 2004/0110472 | A1 | 6/2004 | Witkowski et al. |
| 2004/0153362 | A1 | 8/2004 | Bauer et al. |
| 2004/0153884 | A1 | 8/2004 | Fields et al. |
| 2004/0172177 | A1* | 9/2004 | Nagai ..... G07C 5/085 701/33.4 |
| 2004/0203379 | A1 | 10/2004 | Witkowski et al. |
| 2004/0227523 | A1 | 11/2004 | Namaky |
| 2004/0249557 | A1 | 12/2004 | Harrington et al. |
| 2005/0021294 | A1 | 1/2005 | Trsar et al. |
| 2005/0060070 | A1 | 3/2005 | Kapolka et al. |
| 2005/0125115 | A1 | 6/2005 | Hiwatashi et al. |
| 2005/0143882 | A1 | 6/2005 | Umezawa |
| 2005/0159923 | A1 | 7/2005 | Huang |
| 2005/0203683 | A1 | 9/2005 | Olsen et al. |
| 2005/0228560 | A1 | 10/2005 | Doherty et al. |
| 2005/0267655 | A1 | 12/2005 | Gessner |
| 2006/0027650 | A1 | 2/2006 | Andreasen et al. |
| 2006/0041348 | A1 | 2/2006 | Liebl et al. |
| 2006/0041349 | A1 | 2/2006 | Chinnadurai et al. |
| 2006/0095230 | A1 | 5/2006 | Grier et al. |
| 2006/0101311 | A1 | 5/2006 | Lipscomb et al. |
| 2006/0149434 | A1 | 7/2006 | Bertosa et al. |
| 2006/0161313 | A1 | 7/2006 | Rogers et al. |
| 2006/0161390 | A1 | 7/2006 | Namaky et al. |
| 2007/0005201 | A1 | 1/2007 | Chenn |
| 2007/0010922 | A1 | 1/2007 | Buckley |
| 2007/0073459 | A1 | 3/2007 | Webster et al. |
| 2007/0124040 | A1 | 5/2007 | Chen |
| 2007/0152503 | A1 | 7/2007 | Kowalick |
| 2007/0233341 | A1 | 10/2007 | Logsdon |
| 2007/0250228 | A1 | 10/2007 | Reddy et al. |
| 2008/0004762 | A1 | 1/2008 | Seashore et al. |
| 2008/0015748 | A1 | 1/2008 | Nagy |
| 2008/0045274 | A1 | 2/2008 | Witkowski et al. |
| 2008/0071439 | A1 | 3/2008 | Bertosa et al. |
| 2008/0133432 | A1 | 6/2008 | Ramseyer |
| 2008/0140281 | A1 | 6/2008 | Morris et al. |
| 2008/0195271 | A1 | 8/2008 | Bertosa et al. |
| 2008/0203153 | A1 | 8/2008 | Keithley et al. |
| 2009/0006476 | A1 | 1/2009 | Andreasen et al. |
| 2009/0021362 | A1 | 1/2009 | Kochie |
| 2009/0216401 | A1 | 8/2009 | Underdal et al. |
| 2009/0276115 | A1 | 11/2009 | Chen |
| 2009/0299900 | A1 | 12/2009 | Chen |
| 2009/0300365 | A1 | 12/2009 | Karmes et al. |
| 2010/0185356 | A1 | 7/2010 | Haas et al. |
| 2010/0205450 | A1 | 8/2010 | Samacke et al. |
| 2010/0262335 | A1 | 10/2010 | Brozovich |
| 2011/0035095 | A1 | 2/2011 | Chinnadurai et al. |
| 2011/0035096 | A1 | 2/2011 | Liebl et al. |
| 2011/0112932 | A1 | 5/2011 | Chen |
| 2011/0125364 | A1 | 5/2011 | Delcroix |
| 2011/0224866 | A1 | 9/2011 | Chen |
| 2011/0264322 | A1 | 10/2011 | Chen |
| 2012/0035805 | A1 | 2/2012 | Wempen |
| 2012/0130583 | A1 | 5/2012 | Bertosa et al. |
| 2013/0304278 | A1 | 11/2013 | Chen |
| 2014/0046800 | A1 | 2/2014 | Chen |
| 2014/0052328 | A1 | 2/2014 | Nguyen et al. |
| 2014/0052531 | A1 | 2/2014 | Kent et al. |
| 2014/0195099 | A1 | 7/2014 | Chen |
| 2014/0195101 | A1 | 7/2014 | Chen et al. |
| 2015/0066781 | A1 | 3/2015 | Johnson et al. |
| 2015/0187146 | A1 | 7/2015 | Chen et al. |
| 2015/0206357 | A1 | 7/2015 | Chen et al. |
| 2015/0226563 | A1 | 8/2015 | Cox et al. |
| 2015/0228129 | A1 | 8/2015 | Cox et al. |
| 2016/0078403 | A1 | 3/2016 | Sethi et al. |

FOREIGN PATENT DOCUMENTS

| | | | |
|---|---|---|---|
| FR | 2641085 | B1 | 5/1991 |
| JP | 07009388 | B2 | 2/1995 |
| JP | 07018779 | B2 | 3/1995 |
| WO | 8906839 | A1 | 7/1989 |

OTHER PUBLICATIONS

OTC's Latest Innovations, 1989 (6 pages).

Equus Products, Inc. Manual-ECM Code Reader, Model 3007, 1993 (18 pages).

Equus Products, Inc. Manual-ECM Code Reader, Model 3008, 1993 (5 pages).

Manuel-ECM Code Reader, Model 3007, 1993 by Equus Products, Inc. (18 pages).

Manuel-ECM Code Reader-Model 3008, 1993 by Equus Products, Inc. (5 pages).

Equus Products, Inc. Catalog, Automotive Testers, Gauge and Tachometers and Cruise Control, 1995 (28 pages).

Sensor Testers Product Comparison (4 pages), 1995, (month not available).

Sunpro Sensor Testers Product Comparison, 1995 (4 pages).

Sunpro Catalog by Actron, Nov. 1996 (20 pages).

Equus Products, Inc. Catalog, 1998 (32 pages).

OTC System 2000 Diagnostic Testers and Tool (24 pages), undated, (date not available.

OTC System 2000 Diagnostic Testers and Tools, undated (24 pages).

EPA Performing Onbard Diagnostic System Checks as Part of a Vehicle Inspection and Maintenance Program, Jun. 2001, 25 pages) *.

(56) References Cited

OTHER PUBLICATIONS

EPA Performing Onboard Diagnostic System Checks as Part of a Vehicle Inspection and Maintenance Program, Jun. 2001 (25 pages).

* cited by examiner

MULTI-FUNCTIONAL AUTOMOTIVE DIAGNOSTIC TABLET WITH INTERCHANGEABLE FUNCTION-SPECIFIC CARTRIDGES

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to an automotive diagnostic device, and more specifically to a multi-functional automotive diagnostic device including a base unit configured to be interchangeably engageable with various function-specific cartridges.

2. Description of the Related Art

The routine maintenance of an automobile may require the use of several different automotive tools. For instance, a scan tool may be used to connect to an onboard vehicle computer to retrieve diagnostic data therefrom. Once retrieved, the data may be analyzed to derive a possible vehicle fix. Another tool commonly used in vehicle diagnostics is a battery tester, which may be connectable to the battery on a vehicle for testing the battery. Vehicle diagnostics may additionally include the use of an inspection camera, which may be inserted into a small opening or passageway in the vehicle to allow for inspection or observation of the environment within the passageway. The aforementioned scan tool, battery tester, and inspection camera are merely a few examples of the various automotive diagnostic tools that may be used on a vehicle.

Many conventional automotive diagnostic tools include an instrument and a user interface which allows a user to control operation of the associated instrument. The instrument included in conventional automotive diagnostic tools is typically associated with a single function (e.g., scanning diagnostic data, testing a battery, capturing images, etc.). The user interface may also be configured to display content or data associated with use of the instrument. For instance, in the case of a scan tool, there may be a display screen for displaying information related to the diagnostic data retrieved from the vehicle. The battery tester and inspection camera may also both include respective display screens for displaying detected voltage readings (in the case of the battery tester) or captured images or video (in the case of the inspection camera).

Many repair shops and automotive enthusiasts may own several conventional automotive diagnostic tools to allow for access to the specific functionality associated with each tool. The purchase of several conventional tools, while providing the owner with the desired functionality, may be associated with several deficiencies. One of the most significant drawbacks associated with owning several automotive diagnostic tools may be significant cost. Purchasing several single-function tools may entail considerable expense and may not allow for any realization of shared resources or economies. Another significant drawback may be that each tool must be individually stored and readily retrievable when needed. The tools may be bulky in size and may not lend itself to easy storage, particularly if space is not readily available. Yet another deficiency associated with single function tools is that when multiple tools are needed, the user may have to switch between different tools, which may be time consuming and tedious.

Accordingly, there is a need in the art for a multi-functional automotive diagnostic device, which may provide for an efficient use of common resources, such as a shared user interface, which may result in cost savings and ease of use. Various aspects of the present disclosure address this particular need, as will be discussed in more detail below.

BRIEF SUMMARY

In accordance with one embodiment of the present disclosure, there is provided a multi-functional automotive diagnostic device including a base unit interchangeably engageable with a plurality of function-specific cartridges. The base unit may include a user interface that is configurable to facilitate operation of an automotive tool associated with a given cartridge operatively connected to the base unit. Accordingly, the resources of the base unit may be shared and customized in response to connection of the base unit with various function-specific automotive tools. Thus, economies may be realized by sharing the resources of the base unit, rather than reproducing those resources in several different function specific tools.

According to one embodiment, there is provided a multi-functional automotive diagnostic device comprising a main body having a base engagement element. A display screen is connected to the main body, and a main processing unit is located within the main body. A user input is in operative communication with the processing unit. The device additionally includes a first cartridge and a second cartridge interchangeably engageable with the main body. The first cartridge includes a first body having a first engagement element selectively engageable with the base engagement element. A first diagnostic tool is connected to the first body and is associated with a first vehicle diagnostic function. The first cartridge additionally includes a first processing unit in operative communication with the first diagnostic tool and disposable in communication with the main processing unit when the first engagement element is engaged with the base engagement element for configuring the display screen and user input to operate in accordance with the first vehicle diagnostic function. The second cartridge includes a second body having a second engagement element selectively engageable with the base engagement element. A second diagnostic tool is connected to the second body and is associated with a second vehicle diagnostic function. The second cartridge additionally includes a second processing unit in operative communication with the second diagnostic tool and disposable in communication with the main processing unit when the second engagement element is engaged with the base engagement element for configuring the display screen and user input to operate in accordance with the second vehicle diagnostic function.

The user input may be integrated into the display screen such that the user input and display screen collectively define a touch screen display.

The base engagement element may include a base flange extending over a main body engagement surface to define a channel therebetween. The first engagement element may include a first flange configured to be translatably received within the channel when the first engagement element is engaged with the base engagement element, and the second engagement element may include a second flange configured to be translatably received with the channel when the second engagement element is engaged with the base engagement element.

The main body may include an outer surface, and a pair of projections extending from the outer surface, with each projection extending away from the outer surface and terminating to define an apex. The apexes of the pair of projections may reside in a common plane.

The main body may include a pair of arcuate surfaces positioned in opposed relation to each other, with each arcuate surface being convex in configuration.

According to another embodiment, there is provided a multi-functional automotive diagnostic device comprising a base unit having a display screen and a base electrical connector. The device additionally includes a first cartridge including a first body, a first electrical connector, and a first automotive tool connected to the first body and in operative communication with the first electrical connector. The device further includes a second cartridge including a second body, a second electrical connector, and a second automotive tool connected to the second body and in operative communication with the second electrical connector. The first and second cartridges are interchangeably engageable with the base unit, such that engagement of the first cartridge to the base unit occurs when the first electrical connector is electrically connected to the base electrical connector which configures the base unit to operate in accordance with the first automotive tool and engagement of the second cartridge to the base unit occurs when the second electrical connector is electrically connected to the base electrical connector which configures the base unit to operate in accordance with the second automotive tool.

The display screen may be a touch screen configured to receive user input through manual contact therewith.

The base unit may include a base flange extending over a main body engagement surface to define a channel therebetween. The first cartridge may include a first flange configured to be translatably received within the channel when the first cartridge is engaged with the base unit, and the second cartridge may include a second flange configured to be translatably received with the channel when the second cartridge is engaged with the base unit.

According to yet another embodiment, there is provided a multi-functional automotive diagnostic device configured for interchangeable use with a first cartridge including a first automotive tool and a second cartridge including a second automotive tool. The device includes a main body having a base engagement element configured to be interchangeably engageable with the first and second cartridges. An interface assembly is connected to the main body and includes a display screen connected to the main body, and a main processing unit located within the main body. The interface assembly additionally includes a user input in operative communication with the main processing unit. The interface assembly is configurable to operate in a first operative mode associated with the first automotive tool in response to engagement of the first cartridge to the main body. The interface assembly is additionally configurable to operate in a second operative mode associated with the second automotive tool in response to engagement of the second cartridge to the main body.

There is also provided a method of configuring an automotive diagnostic tool. The method includes connecting a first cartridge having a first automotive tool to a base unit having an interface assembly including a display screen, a main processing unit, and a user input in operative communication with the main processing unit, with the interface assembly being configurable to operate in a first operative mode associated with the first automotive tool in response to connection of the first cartridge to the base unit. The method additionally includes disconnecting the first cartridge from the base unit, and connecting a second cartridge having a second automotive tool to the base unit, with the interface assembly being configurable to operate in a second operative mode associated with the second automotive tool in response to connection of the second cartridge to the base unit.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
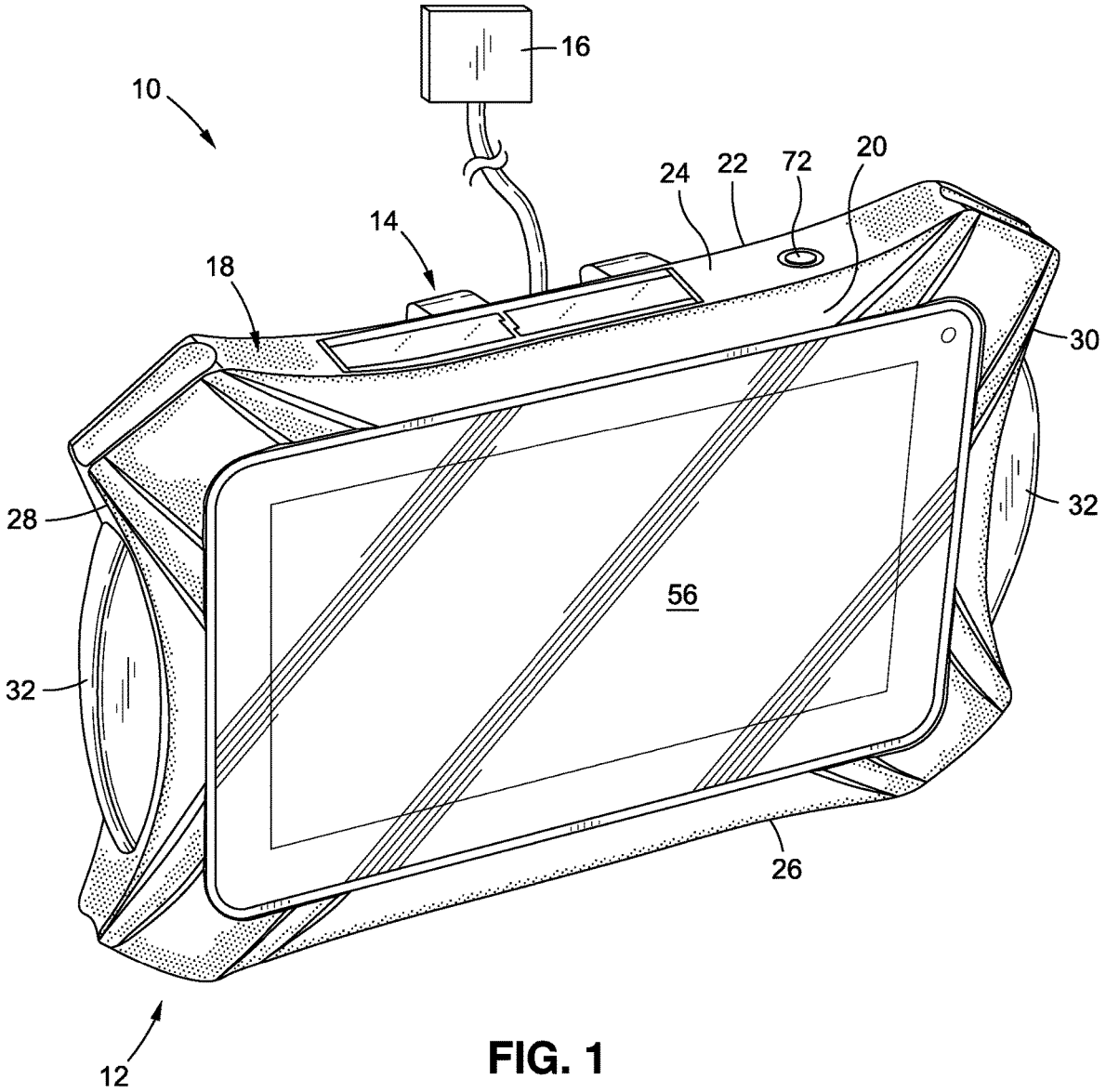
FIG. 1 is a front upper perspective view of an automotive diagnostic device in accordance with an embodiment of the present disclosure.

The detailed description set forth below in connection with the appended drawings is intended as a description of certain embodiments of a multi-functional automotive diagnostic device and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings, wherein the showings are for purposes of illustrating a preferred embodiment of the present disclosure, and is not for purposes of limiting the same, there is depicted a multi-functional automotive diagnostic device 10 capable of being selectively configured to operate in different modes of operation. The device 10 generally includes a base unit 12 capable of being interchangeably connected to various cartridges 14. The base unit 12 may include a user interface, and each cartridge 14 may include a diagnostic instrument 16 and operating instructions for configuring the user interface in response to engagement between the cartridge 14 and the base unit 12. In this regard, the base unit 12 and cartridges 14 may be configured such that attachment of a first cartridge 14 to the base unit 12 may result in configuration of the base unit 12 to operate in accordance with a first mode associated with the first cartridge 14. If the first cartridge 14 is replaced with a second cartridge 14, the base unit 12 may be configured to operate in a second mode different from the first mode and associated with the second cartridge 14. Thus, the resources of the base unit 12 may be shared among a plurality of different function-specific cartridges, which may provide an economic use of the base unit 12, as well as ease of use due to common hardware (i.e., the base unit 12) used in connection with a variety of different diagnostic functions.

The base unit 12 includes a main body 18 that is sized and configured to be hand-holdable by a user. The main body 18 may include a first face 20, a second face 22, a pair of lengthwise faces 24, 26 and a pair of side faces 28, 30, with the lengthwise and side faces 24, 26, 28, 30 each extending between the first and second faces 20, 22. The lengthwise faces 24, 26 are arranged in spaced, generally opposed relation to each other, as are the side face 28, 30. In the exemplary embodiment, each of the lengthwise faces 24, 26 and the side faces 28, 30 includes a least one segment that has a concave configuration, although it is understood that the faces may have other configurations without departing from the spirit and scope of the present disclosure.

The main body 18 may additionally include a pair of palm rests 32 positioned in opposed relation to each other. Each palm rest 32 may define an arcuate, rounded, convex surface, which protrudes outwardly from a respective side face 28, 30. The palm rests 32 may provide a comfortable surface upon which a user may press his or her hand when gripping the main body 18.

The main body 18 may additionally include a pair of projections 34 extending from an outer surface thereof. The projections 34 may be configured to serve as a finger grip for a user's index finger, middle finger, ring finger and pinkie, when the user grips the main body 18. In this regard, when a user grips both sides of the main body 18, the user may apply opposing forces on the projections 34, with the direction of the force being toward the adjacent side face 28, 30. The exemplary projections 34 include a triangular cross-sectional configuration, such that each projection 34 extends away from the outer surface and terminates at an apex, with each apex extending along a respective axis. The projections 34, and their corresponding axes, may extend in generally parallel relation to each other, or alternatively, the projections 34 and the corresponding axes, may be slightly angled relative to each other such that one set of projection ends may be closer to each other than another set of projection ends. The projections 34 may also be configured to directly contact an underlying support surface 36 and support the remainder of the main body 18 in a user-friendly configuration. Accordingly, the projections 34 may be formed to define generally uniform height relative to the outer surface from which the projections 34 extend. In other words, the axes defined by the apexes may reside in a common plane, which may prevent unbalanced support of the main body 18 on an underlying support surface 36.

Figure 2:
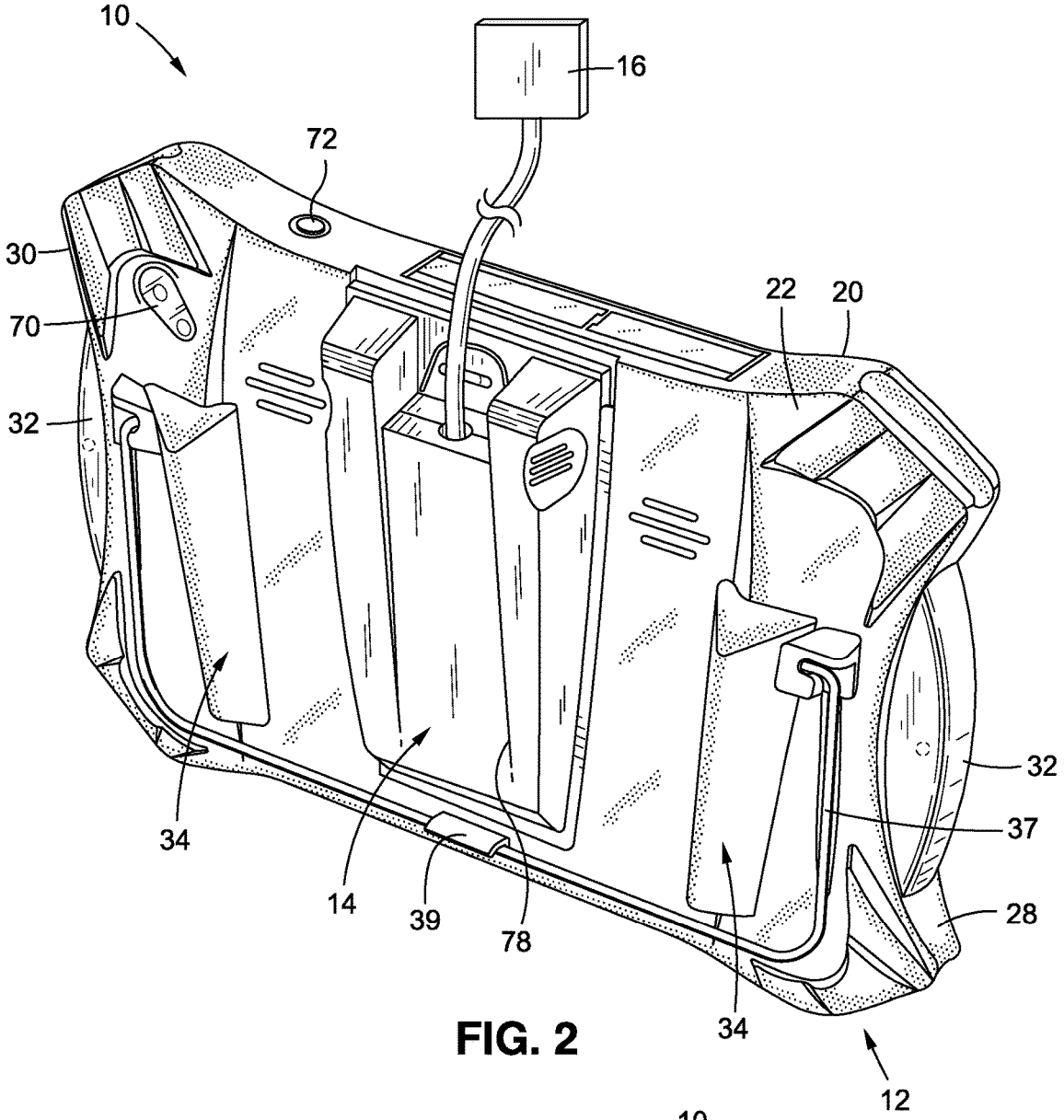
FIG. 2 is a rear upper perspective view of the automotive diagnostic device.
Figure 3:
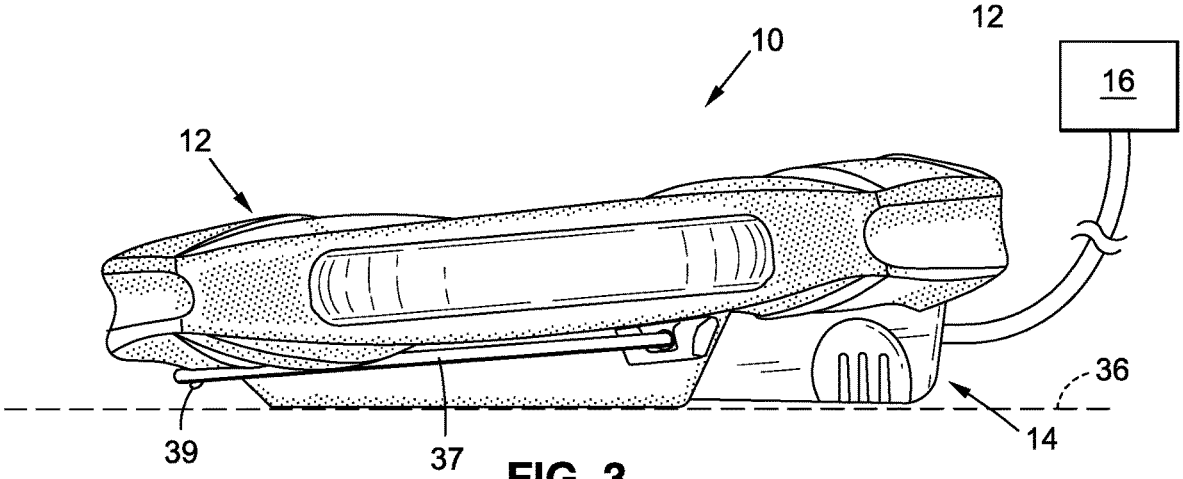
FIG. 3 is a side view of the automotive diagnostic device.
Figures 4, 5:
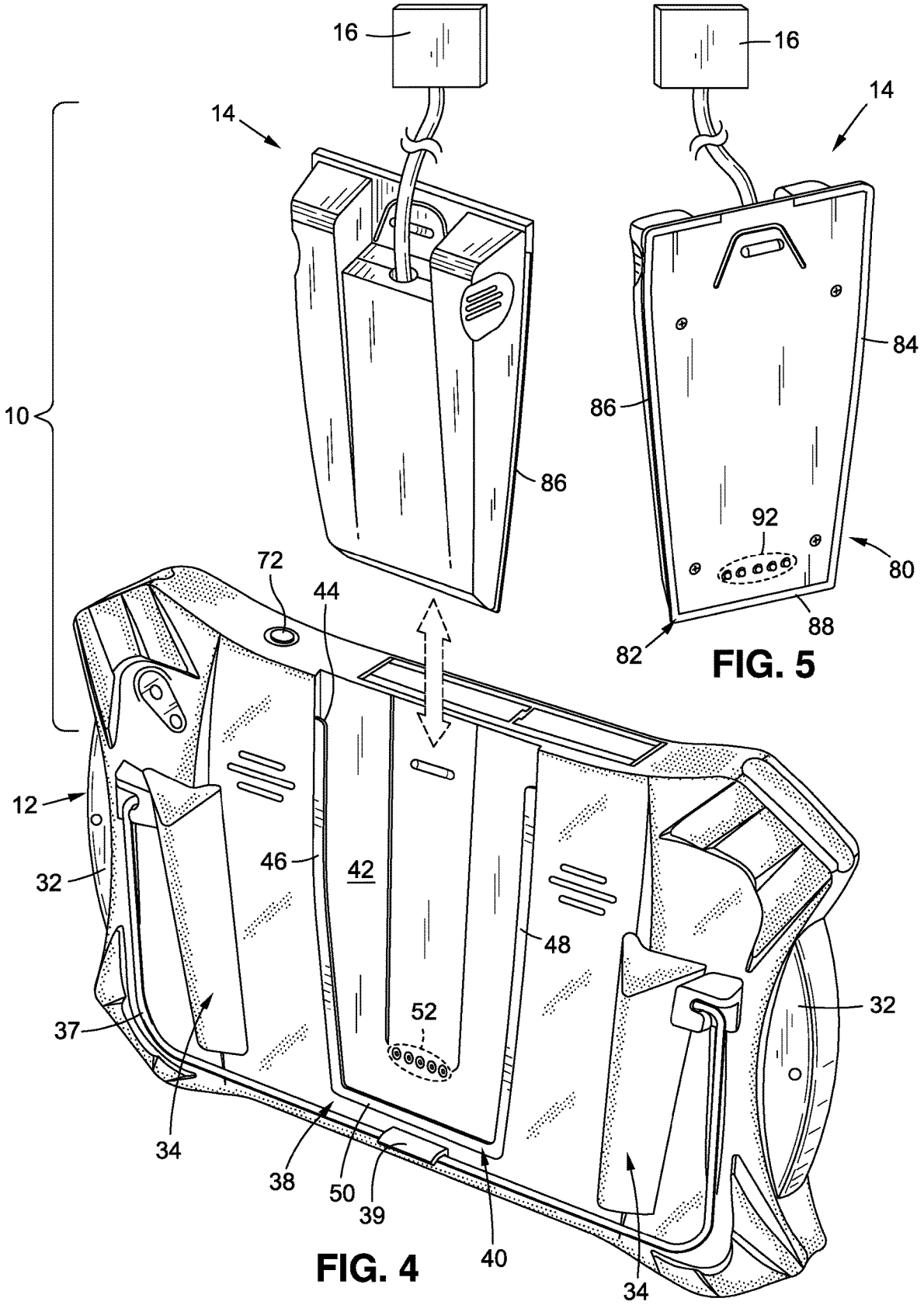
FIG. 4 is a rear upper perspective view of the automotive diagnostic device with a cartridge being shown separated from a base unit.
FIG. 5 is a front perspective view of the cartridge shown in FIG. 3.

In one embodiment, the base unit 12 may include a support stand 37 connected to the main body 18. The support stand 37 may be transitional between a stowed position and a deployed position, relative to the main body 18. FIGS. 2 and 4 show the support stand 37 in the stowed position, with a portion of the support stand 37 being connected to a retaining clip 39. As the support stand 37 transitions from the stowed position toward the deployed position, the angle between the support stand 37 and the main body 18 may increase. Conversely, as the support stand 37 transitions from the deployed position toward the stowed position, the angle between the support stand 37 and the main body 18 may decrease. When in the deployed position, the support stand 37 may elevate one end of the main body 18 relative to a support surface to incline a display screen or user input for optimized interaction with a user.

The base unit 12 may additionally include a base engagement element 38 configured to be interchangeably engageable with various cartridges 14. According to one embodiment, the base engagement element 38 may include a physical connector as well as an electrical connector. The physical connector may include a base flange 40 extending over a main body engagement surface 42 to define a channel 44 therebetween. The flange 40 may include a first side segment 46, a second side segment 48, and an end segment 50 extending between the first and second side segments 46, 48. The first and second side segments 46, 48 may be slightly tapered, such that the distance between the side segments 46, 48 is smallest adjacent the end segment 50, and greatest at the ends spaced from the end segment 50. The tapered configuration may facilitate insertion of the cartridge 14 into the channel 44.

The electrical connector of the base engagement element 38 of the base unit 12 may comprise a base electrical connector 52 which is engageable with a corresponding cartridge electrical connector 92 when the cartridge 14 is connected to the base unit 12. The base electrical connector 52 is connected to the main body 18 and is configured such that at least a portion of the base electrical connector 52 may be externally located on the device 10. In the exemplary embodiment, the base electrical connector 52 includes a plurality of electrical contacts aligned with corresponding openings on the main body 18.

Figure 6:
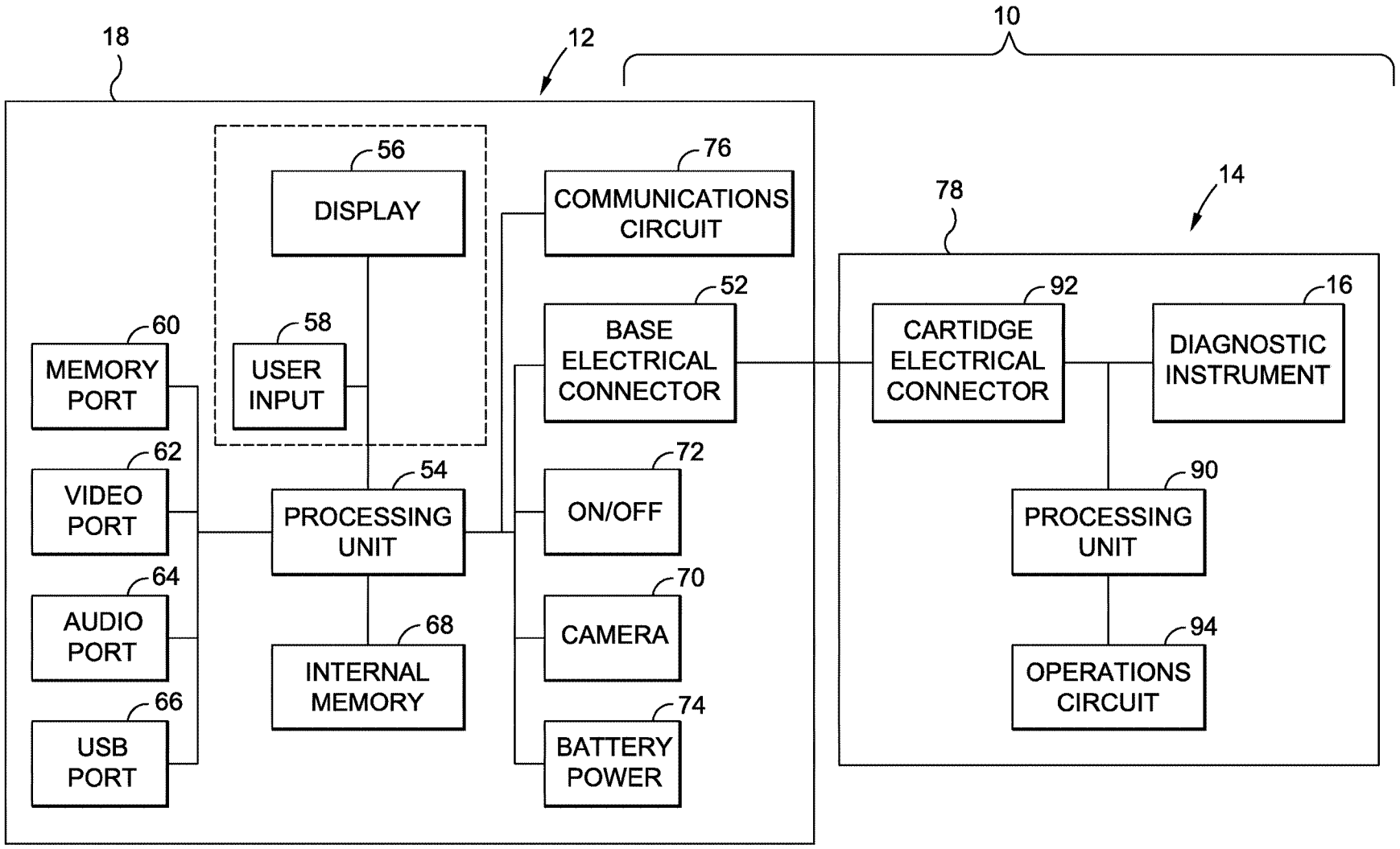
FIG. 6 is a schematic view of the automotive diagnostic device.

The base unit 12 may include several electrical components. Referring now to FIG. 6, there is depicted a schematic view of the electrical components included in an exemplary base unit 12 and a cartridge 14. The base unit 12 may include a processing unit 54 that may be in electrical communication with the various electrical components in the base unit 12 for controlling operation of such components.

The base unit 12 may include a display screen 56 connected to the main body 18 and in communication with the processing unit 54. The display screen 56 may be operative to display information related to operation of diagnostic device 10, such as operation of the diagnostic instrument 16 associated with the cartridge 14 attached to the base unit 12. The display screen 56 may also be used to display content associated with information or data stored on the base unit 12 or on the cartridge 14, as well as information or data received from a remote source, such as via a remote server or content downloaded from the Internet.

The base unit 12 may additionally include a user input 58 coupled to the main body 18 and in communication with the processing unit 54. The user input 58 may include hardware which may be manually actuated by the user to provide the user input. In one embodiment, the user input 58 is integrated into the display screen 56 as a touchscreen display. As such, the user may interface with the touch screen display in a manner similar to a conventional tablet computer. It is also contemplated that the user input 58 may hardware separate from the display, such as buttons, a keypad, etc.

The base unit 12 may additionally include several ports integrated therein to enhance the functionality of the diagnostic device 10. For instance, the base unit 12 may include a memory port 60, a video port 62, an audio port 64, and a universal serial bus (USB) port 66. The memory port 60 may be configured to receive a memory card, chip, or external hard drive to enhance the memory capabilities of the base unit 12.

The video port 62 may include a high-definitional multimedia interface (HDMI) port, or other video interfaces known in the art. In this regard, the video port 62 may allow external display devices to be connected to the base unit 12. When connected to the base unit 12, the external display devices may be capable of displaying content associated with operation of the diagnostic device 10.

The audio port 64 may include a headphone port, speaker port or other audio interface known in the art connectable with headphones, speakers, or the like.

The USB port 66 may be connected to a corresponding USB plug associated with a peripheral device, such as a flash drive, a tool, a communication device, or any other USB connectable resource known in the art.

The base unit 12 may further include an internal memory 68 in communication with the processing unit 54 and operative to store storing information, data, operating instructions, etc. In this regard, the internal memory 68 may be pre-programmed with a set of operating instructions associated with the base unit 12, as well as a prescribed number of possible cartridges 14 that are usable in connection with the base unit 12. Furthermore, it is contemplated that operating instructions may be downloaded onto the internal memory 68 as updates may occur, etc.

The base unit 12 may additionally include one or more cameras 70 for capturing images or video during use of the device 10. The camera(s) 70 may be mounted on any of the faces 20, 22, 24, 26, 28, 30 of the base unit 12.

The base unit 12 may additionally include an ON/OFF switch 72, and a power module 74. The ON/OFF switch 72 may be externally accessible to allow a user to transition the device 10 between being in an ON operational mode and an OFF operational mode. The power module 74 may include a battery or a plug connectable to a power source for supplying power to facilitate operation of the device 10. When the device 10 transitions from the OFF mode to the ON mode, the amount of power drawn from the power source may increase, and conversely, when the device 10 transitions from the ON mode to the OFF mode, the amount of power drawn from the power source may decrease.

The base unit 12 may additionally include a communications circuit 76 to facilitate communications between the diagnostic device 10 and a remote device, such as a remote computer or server. The communications circuit 76 may allow for communication over the Internet, WiFi, Bluetooth, cellular communication network, or other communication capabilities currently known, or later developed, in the art.

As noted above, the base unit 12 is configured to be interchangeably engageable with several cartridges 14 (one at a time) to selectively modify the overall functionality of the device 10. Each cartridge 14 may include a main body 78 including a cartridge engagement element 80 that is selectively engageable with the base engagement element 38. Given the interchangeability of the base engagement element 38 with various cartridge engagement elements 80, it is contemplated that the cartridge engagement elements 80 of the various cartridges 14 may be similar in configuration, and indeed will be identically configured to each other.

According to one embodiment, each cartridge engagement element 80 may include a flange 82 configured to be translatably received within the channel 44 of the base engagement element 38 when the corresponding cartridge 14 is engaged with the base engagement element 38. The flange 82 may include a first side segment 84, a second side segment 86 and an end segment 88 extending between the first and second side segments 84, 86. The side segments 84, 86 and end segment 88 of the flanges 82 on the cartridges 14 may be complementary to the side segments 46, 48 and end segment 50 of the flange 40 on the main body 18.

Each cartridge 14 also includes a diagnostic instrument 16 connected to the cartridge body 78, with the instrument 16 being associated with a respective vehicle diagnostic function. For instance, the diagnostic instrument 16 may include a scan tool, a code reader, a digital multimeter, an inspection camera, a battery tester, a voltage reader, a circuit tester, an infrared thermometer, a remote starter switch, a pressure gauge, a timing light, or any other diagnostic instrument known by those skilled in the art. The instrument 16 may be connected to the cartridge body 78 via a cable, wire, harness or other device. In this regard, the cable, wire, harness, etc., may provide the instrument 16 with sufficient clearance or freedom of movement relative to the cartridge 14 to allow for proper use thereof.

Each cartridge 14 may further include a cartridge processing unit 90 in operative communication with the diagnostic instrument 16 and a cartridge electrical connector 92 in communication with the cartridge processing unit 90. The cartridge electrical connector 92 is selectively engageable with the base electrical connector 52 to place the cartridge 14 in operative communication with the base unit 12, and more specifically, the place the cartridge processing unit 90 in operative communication with the base processing unit 54. When the cartridge 14 is operatively connected to the base unit 12, the display screen 56 and user input may be configured to operate in accordance with the diagnostic instrument 16 included in the attached cartridge 14 to implement the functionality associated with the diagnostic instrument.

According to one embodiment, the cartridge electrical connector 92 includes a plurality of pins that are disposable in contact with respective electrical contacts on the base unit 12 to place the pins in electrical communication with the contacts of the base unit 12. The pins may be retractable to protect the pins during sliding of the cartridge 14 relative to the base unit 12 during insertion and removal of the cartridge 14 relative to the base unit 12.

Although the foregoing describes the use of retractable pins and electrical contacts to facilitate operative connection between the cartridge 14 and the base unit 12, other forms of operative communication known in the art may also be used. For instance, plug-type connectors, or others, may be used without departing from the spirit and scope of the present disclosure.

Each cartridge 14 may additionally include an operations circuit 94 having instructions stored thereon associated with operation of the diagnostic instrument 16, as well as instructions associated with configuration of the user interface on the base unit 12 based on the respective diagnostic instrument 16. In this regard, the instructions may be implemented in response to establishing operative connection between the cartridge 14 and the base unit 12. In one embodiment, the processing unit 54 in the base unit 12 is capable of detecting connection of the cartridge 14 to the base unit 12, and requesting the instructions from the operations circuit 94 in response to such detection. The processing unit 54 on the base unit 12 may be capable of implementing the instructions, while at the same time implementing user inputs received by the user. It is contemplated that any instructions received from the cartridge 14 may serve as a supplement to instructions already stored on the base unit 12.

In another embodiment, the operations circuit 94 may be capable of facilitating operative association between the cartridge 14 and the base unit 12 through the use of a unique identification code associated with the cartridge 14. The identification code may be transmitted or otherwise received by the base processing unit 54 in response to establishment of an operative connection between the cartridge 14 and the base unit 12. The instructions associated the diagnostic instrument of the connected cartridge 14 may be retrieved from a database using the received identification code. The database may be local to the base unit 12, e.g., stored on the internal memory, or retrieved from a remote server using the communications circuit.

It is contemplated that different diagnostic instruments 16 may require different user interfaces, and thus, the instructions, when implemented, may reconfigure the user interface when the cartridge 14 is attached to the base unit 12. For instance, one diagnostic instrument 16 may include an inspection camera, such that when the associated cartridge 14 is attached to the base unit 12, the display is configured to depict a field of view captured by the camera. The user interface may also provide the user with the ability to zoom in and zoom out. Another diagnostic instrument 16 may include a scan tool, such that when the associated cartridge 14 is attached to the base unit 12, the display is configured to create a display which shows the retrieved diagnostic data, and related translations, diagnostic summaries, associated replacement parts and repair procedures, as well as hyperlinks to related information or data.

In use, a user may select a particular cartridge 14, e.g., a first cartridge, from among a plurality of different cartridges 14, with the selected cartridge 14 having a desired diagnostic instrument 16 associated with desired diagnostic functionality. The user may slide the cartridge 14 into the base unit 12, such that the flange 82 on the cartridge 14 extends into the channel 44 and under the flange 40 on the base unit 12. The user continues to advance the cartridge 14 until an operative connection is established through contact between the pins on the cartridge 14 and the contacts on the base unit 12. In response to such connection, the cartridge 14 may receive power from the power supply 74 on the base unit 12, and the base unit 12 may request operational instructions from the cartridge 14, or from some other source. Once the operational instructions are received, the instructions may be implemented by the base processing unit 54, which may include reconfiguring of the display 56 and user input 58 to correspond to the attached diagnostic instrument. Once the configuration is completed, the user may use the device 10 to facilitate the functionality associated with the attached diagnostic instrument.

After using the device 10 with the first cartridge 14 attached thereto, the user may want or need functionality associated with a diagnostic instrument 16 included in a second cartridge 14. Therefore, the user may remove the first cartridge 14 by sliding the first cartridge 14 in a direction opposite to that used to insert the first cartridge 14. Once the first cartridge 14 is removed, the user may connect the second cartridge 14 to the base unit 12 by sliding the second cartridge 14 into the base unit 12, such that the flange 82 on the second cartridge 14 extends into the channel 44 and under the flange 40 on the base unit 12. The user continues to advance the second cartridge 14 until an operative connection is established through contact between the pins on the second cartridge 14 and the contacts on the base unit 12. In response to such connection, the second cartridge 14 may receive power from the power supply 74 on the base unit 12, and the base unit 12 may request operational instructions from the second cartridge 14, or from some other source. Once the operational instructions are received, the instructions may be implemented by the base processing unit 54, which may include reconfiguring of the display 56 and user input 58 to correspond to the attached diagnostic instrument 16. Once the configuration is completed, the user may use the device 10 to facilitate the functionality associated with the attached diagnostic instrument 16.

The ability to interchangeably associate different cartridges 14 and their corresponding diagnostic instruments 16 allows for selective customization of the diagnostic device 10, and allows for realized economies due to the ability to reconfigure and reuse the hardware in the base unit 12 with several different diagnostic instruments. In this regard, by integrating the commonly used hardware, e.g., display screen 56 and user input, into the shared base unit 12, rather than integrating them into several different function specific tools, provides a much more efficient use of resources.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A multi-functional automotive diagnostic device comprising:

a main body having a base engagement element including a base flange extending over a main body engagement surface to define a channel therebetween;

a display screen connected to the main body;

a main processing unit located within the main body;

a user input in operative communication with the processing unit; and a first cartridge and a second cartridge interchangeably engageable with the main body;

the first cartridge including:

a first body having a first engagement element selectively engageable with the base engagement element;

a first diagnostic tool connected to the first body, the first diagnostic tool being associated with a first vehicle diagnostic function; and a first processing unit in operative communication with the first diagnostic tool and disposable in communication with the main processing unit when the first engagement element is engaged with the base engagement element for configuring the display screen and user input to operate in accordance with the first vehicle diagnostic function;

the second cartridge including:

a second body having a second engagement element selectively engageable with the base engagement element;

a second diagnostic tool connected to the second body, the second diagnostic tool being associated with a second vehicle diagnostic function; and a second processing unit in operative communication with the second diagnostic tool and disposable in communication with the main processing unit when the second engagement element is engaged with the base engagement element for configuring the display screen and user input to operate in accordance with the second vehicle diagnostic function.

2. The device as recited in claim 1, wherein the user input is integrated into the display screen such that the user input and display screen collectively define a touch screen display.

3. The device as recited in claim 1, wherein the first engagement element includes a first flange configured to be translatably received within the channel when the first engagement element is engaged with the base engagement element, and the second engagement element includes a second flange configured to be translatably received within the channel when the second engagement element is engaged with the base engagement element.

4. The device as recited in claim 1, wherein the main body includes an outer surface, and a pair of projections extending from the outer surface, each projection extending away from the outer surface and terminating to define an apex.

5. The device as recited in claim 4, wherein the apexes of the pair of projections reside in a common plane.

6. The device as recited in claim 1, wherein the main body includes a pair of arcuate surfaces positioned in opposed relation to each other, each arcuate surface being convex in configuration.

7. A multi-functional automotive diagnostic device comprising:

a base unit having a display screen, a base electrical connector, and a base flange extending over a main body engagement surface to define a channel therebetween;

a first cartridge including a first body, a first electrical connector, and a first automotive tool connected to the first body and in operative communication with the first electrical connector; and a second cartridge including a second body, a second electrical connector, and a second automotive tool connected to the second body and in operative communication with the second electrical connector;

the first and second cartridges being interchangeably engageable with the base unit, such that engagement of the first cartridge to the base unit occurs when the first electrical connector is electrically connected to the base electrical connector which configures the base unit to operate in accordance with the first automotive tool and engagement of the second cartridge to the base unit occurs when the second electrical connector is electrically connected to the base electrical connector which configures the base unit to operate in accordance with the second automotive tool.

8. The device as recited in claim 7, wherein the display screen is a touch screen configured to receive user input through manual contact therewith.

9. The device as recited in claim 7, wherein the first cartridge includes a first flange configured to be translatably received within the channel when the first cartridge is engaged with the base unit, and the second cartridge includes a second flange configured to be translatably received within the channel when the second cartridge is engaged with the base unit.

10. The device as recited in claim 7, wherein the base unit includes an outer surface, and a pair of projections extending from the outer surface, each projection extending away from the outer surface and terminating to define an apex.

11. The device as recited in claim 10, wherein the apexes of the pair of projections reside in a common plane.

12. The device as recited in claim 7, wherein the base unit includes a pair of arcuate surfaces positioned in opposed relation to each other, each arcuate surface being convex in configuration.

13. A multi-functional automotive diagnostic device configured for interchangeable use with a first cartridge including a first automotive tool and a second cartridge including a second automotive tool, the device comprising:

a main body having a base engagement element configured to be interchangeably engageable with the first and second cartridges, the base engagement element including a base flange extending over a main body engagement surface to define a channel therebetween;

an interface assembly connected to the main body and including:

a display screen connected to the main body;

a main processing unit located within the main body;

a user input in operative communication with the main processing unit;

the interface assembly being configurable to operate in a first operative mode associated with the first automotive tool in response to engagement of the first cartridge to the main body;

the interface assembly being configurable to operate in a second operative mode associated with the second automotive tool in response to engagement of the second cartridge to the main body.

14. The device as recited in claim 13, wherein the display screen is a touch screen configured to receive user input through manual contact therewith.

15. The device as recited in claim 13, wherein the channel is sized to translatably receive a portion of the first cartridge when the first engagement element is engaged with the base engagement element, the channel further being sized and configured to translatably receive a portion of the second cartridge when the second engagement element is engaged with the base engagement element.

16. The device as recited in claim 13, wherein the main body includes an outer surface, and a pair of projections extending from the outer surface, each projection extending away from the outer surface and terminating to define an apex.

17. A method of configuring an automotive diagnostic tool, the method comprising the steps of:

connecting a first cartridge having a first automotive tool to a base unit having a base engagement element including a base flange extending over a main body engagement surface to define a channel therebetween, an interface assembly including a display screen, a main processing unit, and a user input in operative communication with the main processing unit, the interface assembly being configurable to operate in a first operative mode associated with the first automotive tool in response to connection of the first cartridge to the base unit;

disconnecting the first cartridge from the base unit; and connecting a second cartridge having a second automotive tool to the base unit, the interface assembly being configurable to operate in a second operative mode associated with the second automotive tool in response to connection of the second cartridge to the base unit.

* * * * *